US012575602B2

(12) United States Patent
Chung et al.

(10) Patent No.: US 12,575,602 B2
(45) **Date of Patent: *Mar. 17, 2026**

(54) AEROSOL GENERATING DEVICE

(71) Applicant: KT&G CORPORATION, Daejeon (KR)

(72) Inventors: Wooseok Chung, Namyangju-si (KR); Ji Seob Woo, Daejeon (KR); Jae Sang Lee, Seoul (KR); Chang Hoon Lee, Gwangju (KR); Kyung Bin Jung, Daejeon (KR)

(73) Assignee: KT&G Corporation, Daejeon (KR)

( * ) Notice: Subject to any disclaimer, the term of this patent is extended or adjusted under 35 U.S.C. 154(b) by 267 days.

This patent is subject to a terminal disclaimer.

(21) Appl. No.: 18/030,318

(22) PCT Filed: Jan. 4, 2023

(86) PCT No.: PCT/KR2023/000117
§ 371 (c)(1),
(2) Date: Apr. 5, 2023

(87) PCT Pub. No.: WO2023/136536
PCT Pub. Date: Jul. 20, 2023

(65) Prior Publication Data

US 2024/0365860 A1 Nov. 7, 2024

(30) Foreign Application Priority Data

Jan. 13, 2022 (KR) ..... 10-2022-0005064

(51) Int. Cl.
*A24F 40/30* (2020.01)
*A24F 40/10* (2020.01)
(Continued)

(52) U.S. Cl.
CPC ..... *A24F 40/30* (2020.01); *A24F 40/10* (2020.01); *A24F 40/20* (2020.01); *A24F 40/42* (2020.01);
(Continued)

(58) Field of Classification Search
CPC ..... A24F 40/42; A24F 40/10; A24F 40/20; A24F 40/30; A24F 40/48; A24F 40/40
See application file for complete search history.

(56) References Cited

U.S. PATENT DOCUMENTS 5,666,977 A 9/1997 Higgins et al.
9,888,721 B2 2/2018 Chan
(Continued)

FOREIGN PATENT DOCUMENTS

CN 113439877 A 9/2021
CN 214759158 U 11/2021
(Continued)

OTHER PUBLICATIONS

Office Action issued Apr. 23, 2024 in Japanese Application No. 2023-515205.
(Continued)

*Primary Examiner* — Michael H. Wilson
*Assistant Examiner* — Jennifer A Kessie
(74) *Attorney, Agent, or Firm* — Foley & Lardner LLP

(57) ABSTRACT

An aerosol generating device includes a housing, a cartridge insertable into the housing and configured to store at least one liquid, an actuator provided on one side of the cartridge in the housing and configured to push the liquid out of the cartridge, and an article insertion portion provided on the other side of the cartridge and configured such that the aerosol generating article is insertable thereinto.

16 Claims, 7 Drawing Sheets

(51) Int. Cl.

| | |
|---|---|
| ***A24F 40/20*** | (2020.01) |
| ***A24F 40/42*** | (2020.01) |
| ***A24F 40/485*** | (2020.01) |
| ***A24F 40/51*** | (2020.01) |
| ***A24F 40/65*** | (2020.01) |

(52) U.S. Cl.
CPC ..... *A24F 40/485* (2020.01); *A24F 40/51* (2020.01); *A24F 40/65* (2020.01)

(56) References Cited

U.S. PATENT DOCUMENTS

| | | | | |
|---|---|---|---|---|
| 10,791,769 | B2 | 10/2020 | Bless et al. | |
| 2015/0047656 | A1 | 2/2015 | Robinson et al. | |
| 2016/0192712 | A1 | 7/2016 | Memari et al. | |
| 2020/0060338 | A1 | 2/2020 | Danek | |
| 2020/0113232 | A1* | 4/2020 | Bless | A24F 40/30 |
| 2020/0114095 | A1* | 4/2020 | Holroyd | A61M 15/003 |
| 2020/0154768 | A1* | 5/2020 | Han | A24F 40/60 |
| 2023/0051230 | A1* | 2/2023 | Batista | A24F 40/30 |

FOREIGN PATENT DOCUMENTS

| | | | |
|---|---|---|---|
| CN | 214759159 | U | 11/2021 |
| JP | 2016-521588 | A | 7/2016 |
| JP | 2017-506890 | A | 3/2017 |
| JP | 2021-508239 | A | 3/2021 |
| JP | 2021-533730 | A | 12/2021 |
| KR | 10-2016-0119773 | A | 10/2016 |
| KR | 10-2019-0039810 | A | 4/2019 |
| KR | 10-2019-0078638 | A | 7/2019 |
| KR | 10-2021-0111070 | A | 9/2021 |
| WO | 2007/039794 | A2 | 4/2007 |
| WO | WO-2020/209111 | A1 | 10/2020 |
| WO | 2021/005611 | A2 | 1/2021 |
| WO | 2021/071256 | A2 | 4/2021 |
| WO | WO-2021/148361 | A1 | 7/2021 |

OTHER PUBLICATIONS

Korean Office Action dated Jul. 19, 2023 in Korean Application No. 10-2022-0005064.

International Search Report issued Apr. 4, 2023 in International Application No. PCT/KR2023/000117.

Extended European Search Report issued on Oct. 17, 2025, for the corresponding EP Application No. 23725945.2.

Chinese Office Action on CN Patent Appl. No. 202380009098.4 dated Jan. 6, 2026.

* cited by examiner

[Fig. 1]
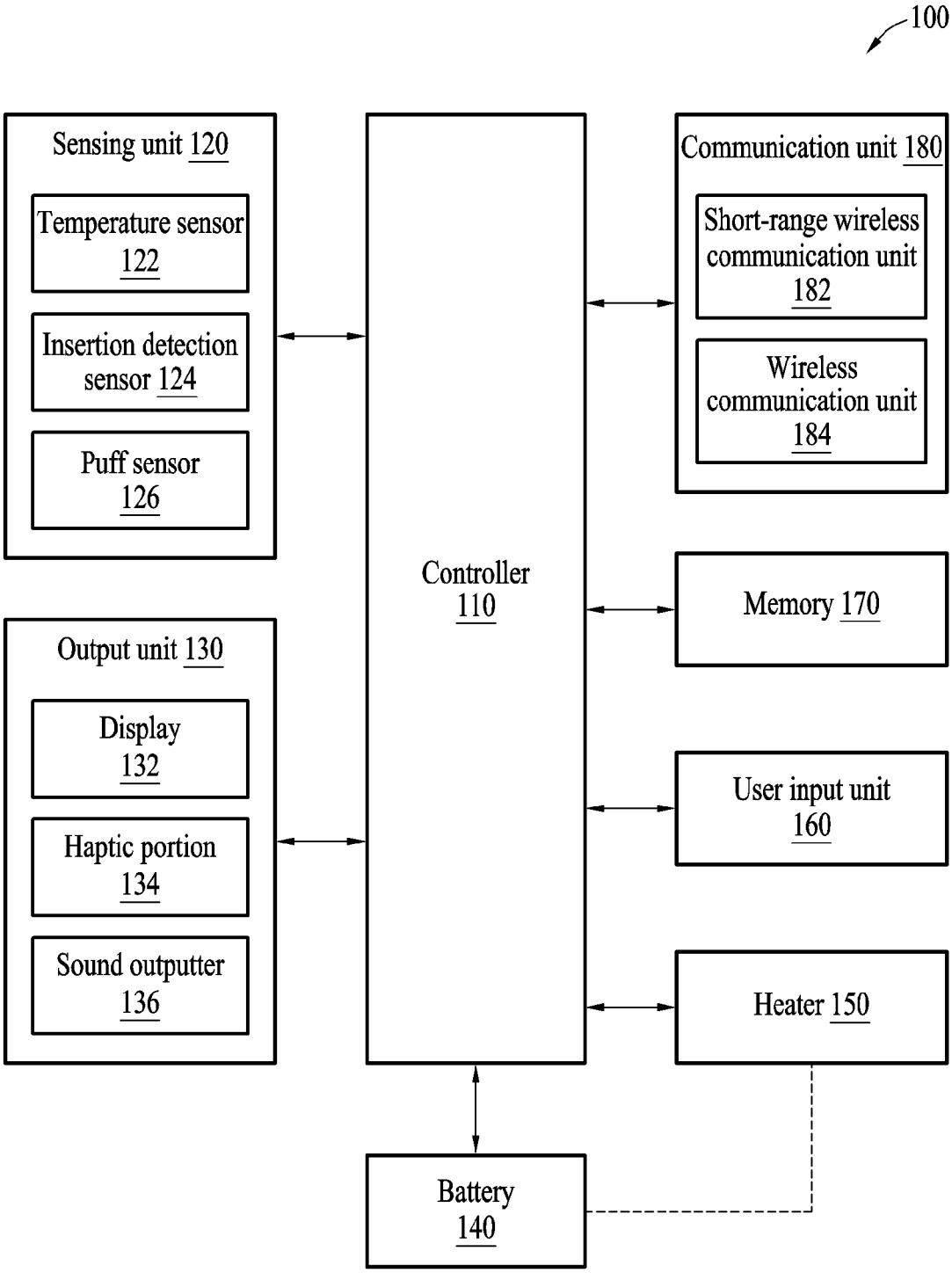

[Fig. 2]
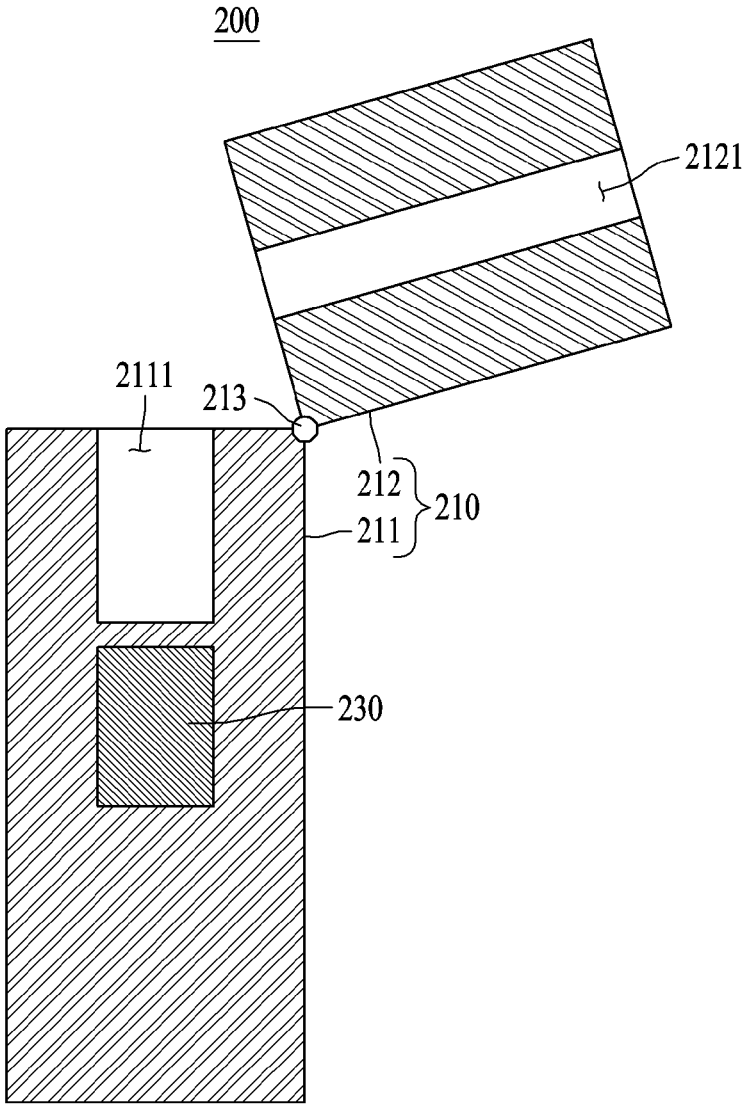

[Fig. 3]
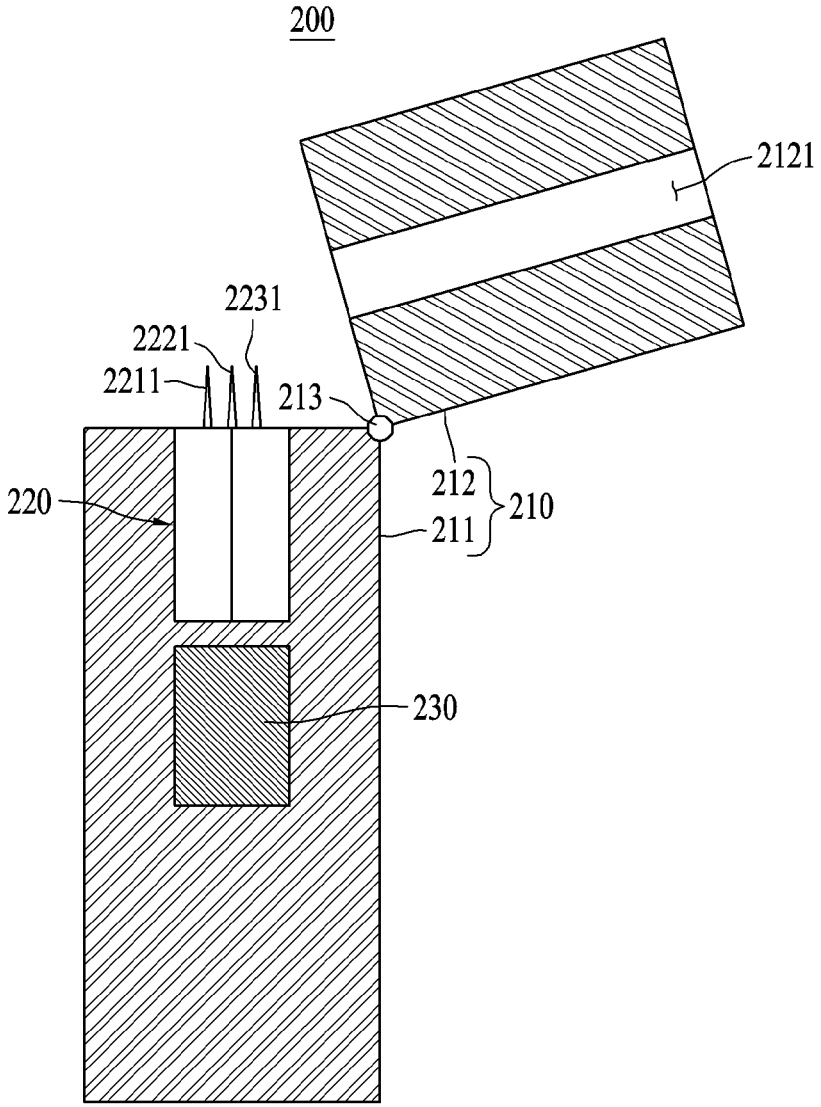

[Fig. 4a]
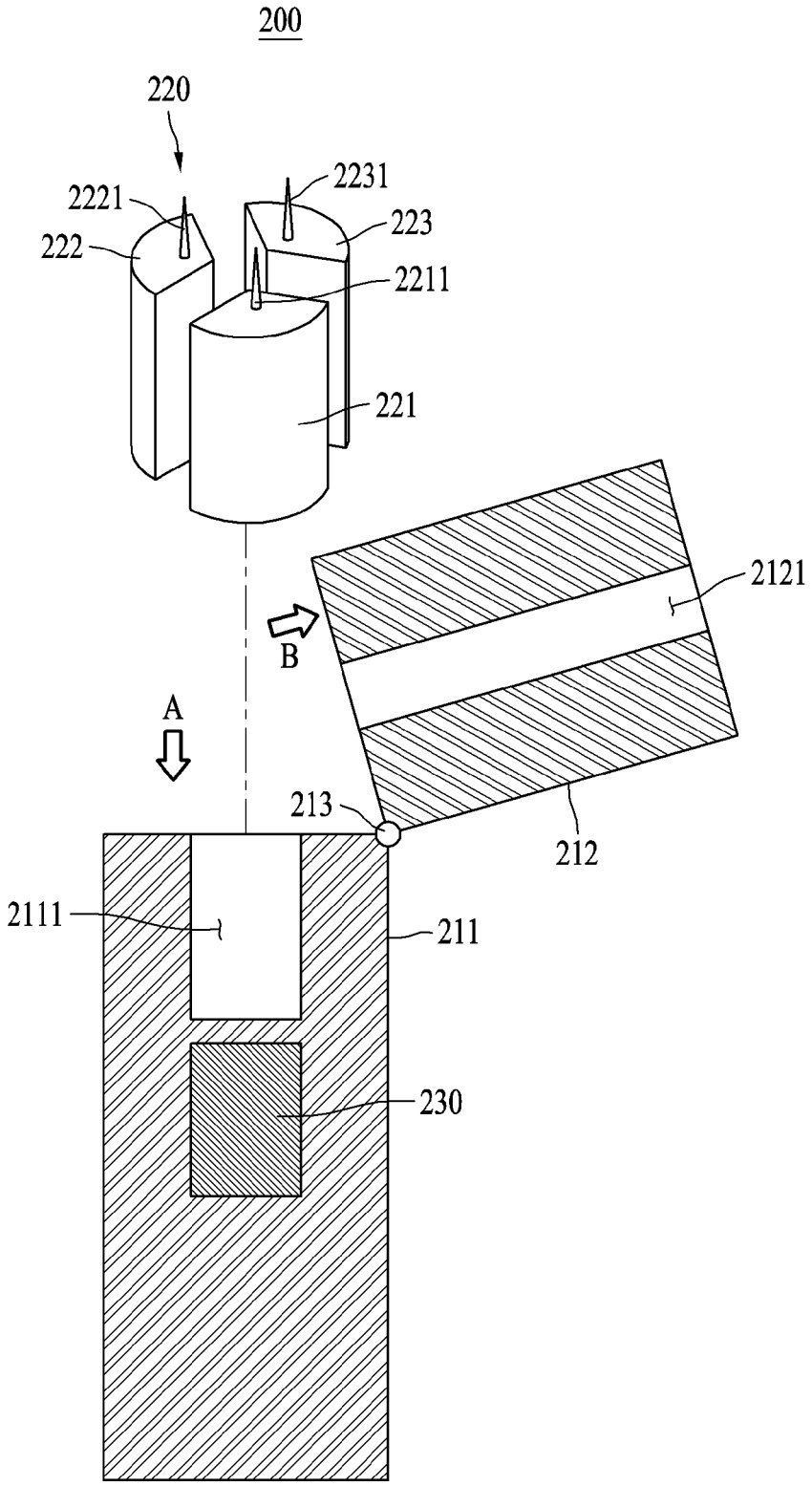

[Fig. 4b]
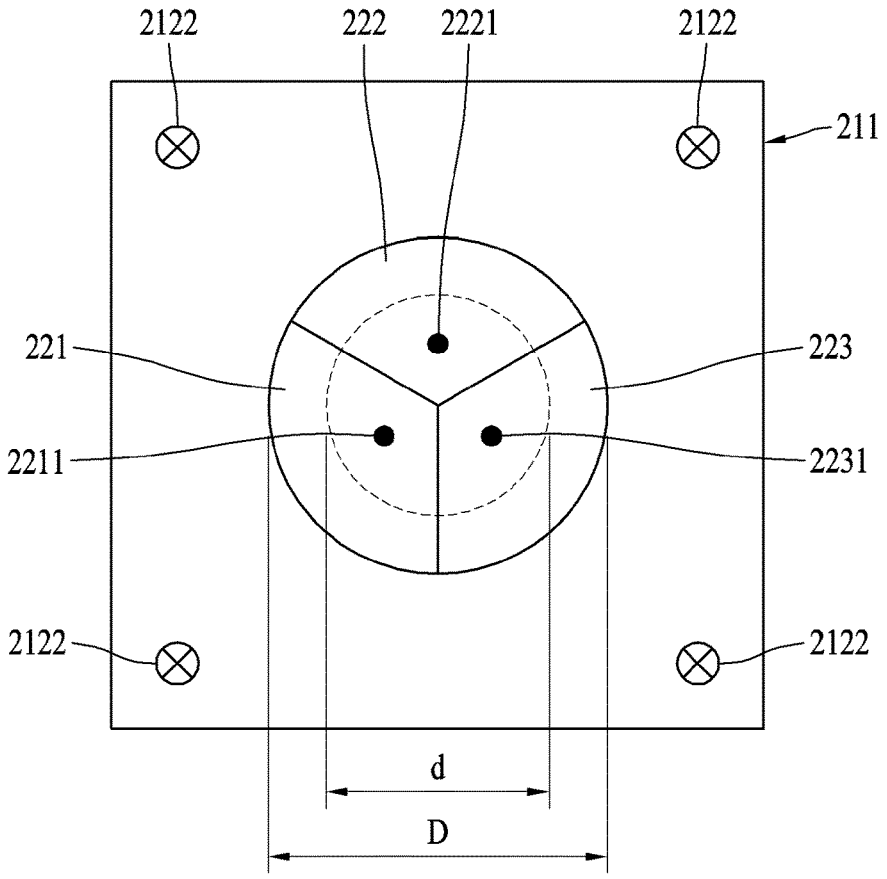
[Fig. 4c]
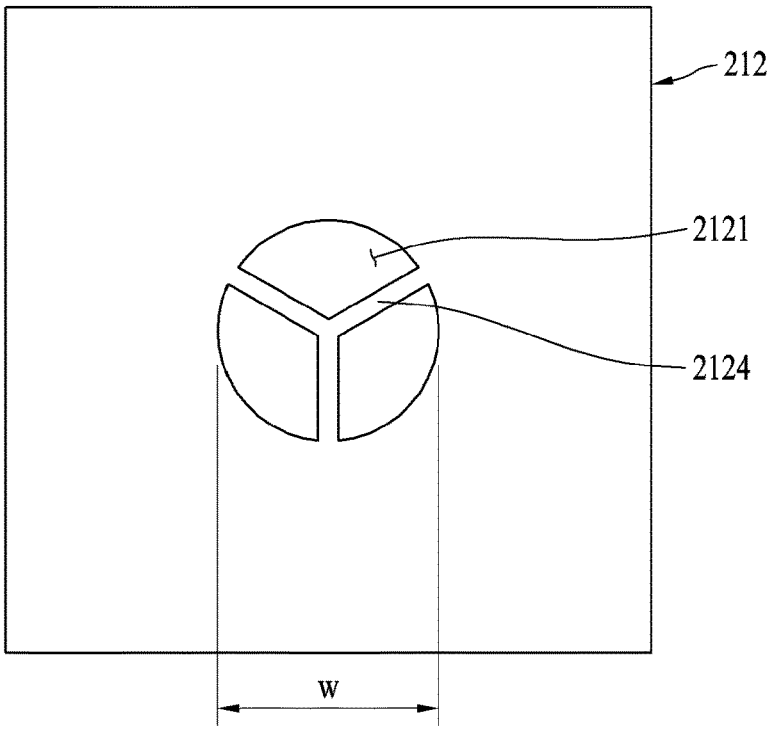

[Fig. 5]
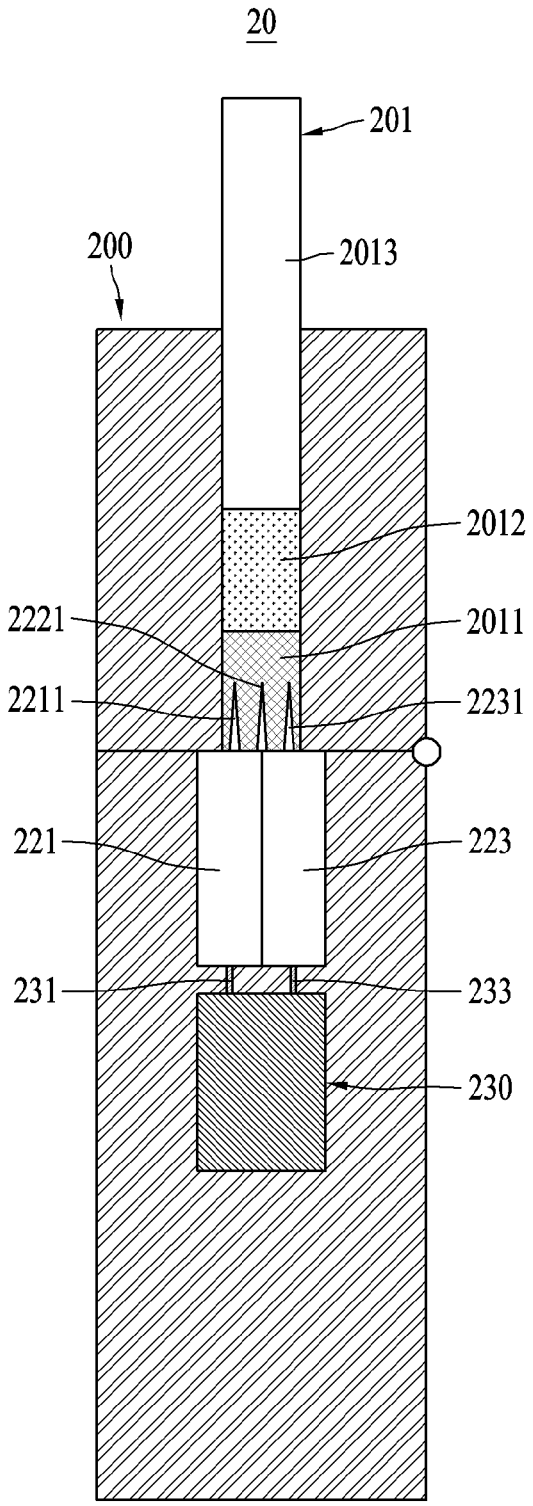

[Fig. 6]
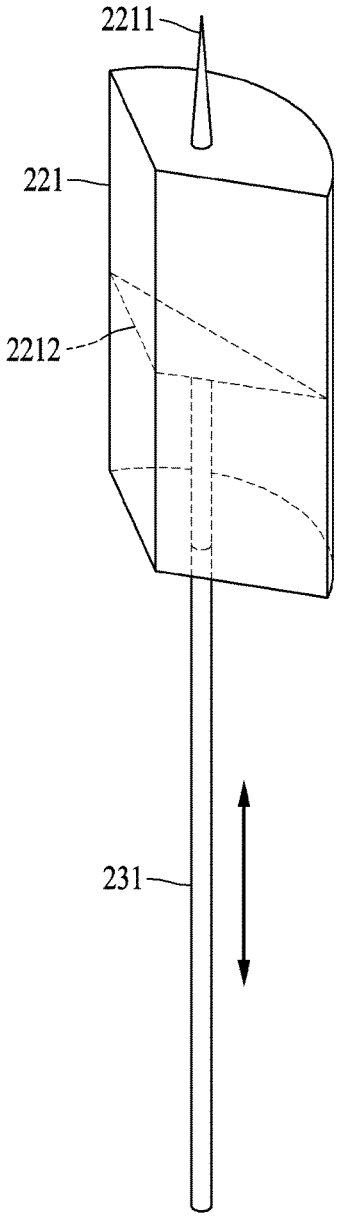
[Fig. 7]
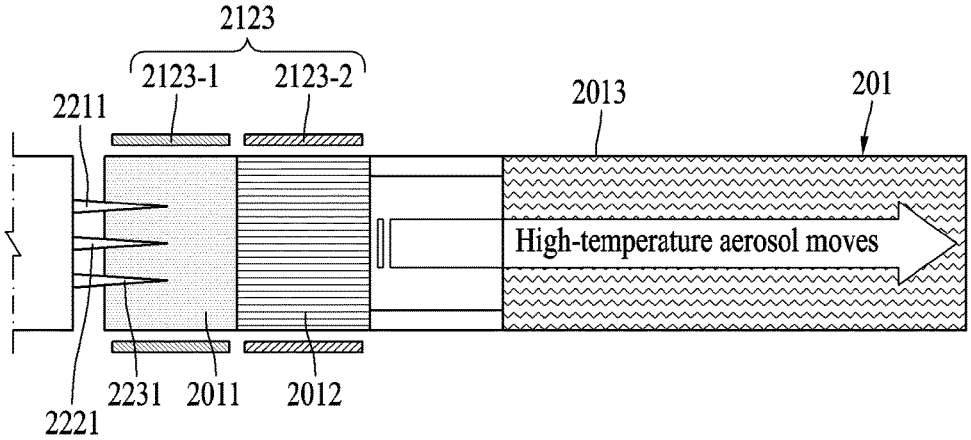

AEROSOL GENERATING DEVICE

TECHNICAL FIELD

One or more embodiments relate to an aerosol generating device.

BACKGROUND ART

Techniques for introducing airflows into an aerosol generating article have been developed to improve atomization performance. For example, aerosol generating devices that generate an aerosol from an aerosol generating article in a non-burning manner are being developed.

DISCLOSURE OF INVENTION

Technical Problem

An aerosol generating device according to embodiments may deliver liquid fragrances stored in a cartridge to an aerosol generating article.

Solution to Problem

According to an embodiment, an aerosol generating device includes a housing, a cartridge insertable into the housing and configured to store at least one liquid, an actuator provided in the housing and configured to push the liquid in the cartridge, and an article insertion portion provided on the cartridge and configured to receive an aerosol generating article.

In an embodiment, the cartridge may include a first cartridge part configured to accommodate a first liquid fragrance, and a second cartridge part configured to accommodate a second liquid fragrance. The actuator may include a first push bar configured to push one end of the first cartridge part, and a second push bar configured to push one end of the second cartridge part.

In an embodiment, the cartridge may include a cartridge part configured to accommodate a liquid fragrance, a liquid injection pin protruding from one end of the cartridge part and configured to communicate with an inside of the cartridge part, and a cartridge head provided in the cartridge part and configured to move in the cartridge part.

The cross section of the cartridge part may be constant when taken along a horizontal cutting plane perpendicular to a longitudinal direction, and the cartridge head may have a shape corresponding to the cross section of the cartridge part so as to seal the inside of the cartridge part.

The actuator may include a push bar connected to the cartridge head, and a driving element configured to push and pull the push bar in the longitudinal direction.

In an embodiment, the housing may include a first housing part configured to receive the cartridge and the actuator, and a second housing part connected to the first housing part and provided with the article insertion portion, wherein the first housing part may be provided with a cartridge receiver for receiving the cartridge, and the article insertion portion may be formed to penetrate through the second housing part and aligned with the cartridge receiver.

The first housing part and the second housing part may be connected by a hinge.

A diameter of the cartridge receiver may be greater than a diameter of the article insertion portion.

One of the first housing part and the second housing part may include a protrusion protruding toward the other of the first housing part and the second housing part, the protrusion may form a separation space between the first housing part and the second housing part, and the separation space and the article insertion portion may communicate with each other to form an airflow path.

In an embodiment, the aerosol generating device may further include a cartridge holder provided on one side of the second housing part facing the first housing part, wherein the cartridge holder may be configured to hold the cartridge in place within the cartridge receiver.

In an embodiment, a heater may be provided on at least a portion of a perimeter of the article insertion portion.

According to another embodiment, an aerosol generating device includes a housing, a cartridge insertable into the housing and including a plurality of cartridge parts configured to accommodate different liquids, an actuator provided in the housing and configured to activate the cartridge parts, and an article insertion portion provided on the cartridge and configured to receive an aerosol generating article, wherein the actuator may activate the cartridge parts individually such that at least one of the liquids may be delivered to the article insertion portion.

The cartridge may include a first cartridge part configured to accommodate a first liquid fragrance, and a second cartridge part configured to accommodate a second liquid fragrance, wherein the actuator may include a plurality of push bars configured to push the first cartridge part and the second cartridge part, respectively, and the first liquid fragrance and the second liquid fragrance may be delivered to the article insertion portion.

The housing may include a first housing part, and a second housing part connected to the first housing part by a hinge, a cartridge receiver for receiving the cartridge may be provided on one side of the first housing part facing the second housing part to receive the cartridge, the article insertion portion may be formed to penetrate through the second housing part, and the actuator, the cartridge receiver, and the article insertion portion may be aligned in a line.

According to still another embodiment, an aerosol generating device includes a housing, a cartridge insertable into the housing and including a liquid injection pin which communicates with an inside where a liquid is accommodated, an article insertion portion disposed to be in contact with the cartridge and configured to receive an aerosol generating article, wherein the liquid injection pin may protrude toward the article insertion portion.

The aerosol generating device may further include an actuator configured to push the liquid in the cartridge, wherein the cartridge may include a cartridge head configured to move in a cartridge part to push the liquid toward the liquid injection pin, and the actuator may include a push bar connected to the cartridge head, and a driving element configured to push and pull the push bar.

Advantageous Effects of Invention

According to embodiments, it is possible to provide various combinations of flavors to an aerosol generating article inserted into an aerosol generating device.

According to embodiments, it is possible to precisely control the degree of one or more flavors to be delivered to an aerosol generating article.

The effects of the aerosol generating device according to embodiments are not limited to the above-mentioned effects, and other unmentioned effects can be clearly understood from the following description by one of ordinary skill in the art.

BRIEF DESCRIPTION OF DRAWINGS

The foregoing and other aspects, features, and advantages of embodiments in the disclosure will become apparent from the following detailed description with reference to the accompanying drawings.

FIG. 1 is a block diagram of an aerosol generating device according to an embodiment.

FIG. 2 illustrates an open state of an aerosol generating device according to an embodiment.

FIG. 3 illustrates a state of an aerosol generating device with a cartridge inserted thereinto according to an embodiment.

FIG. 4A illustrates an example of inserting a plurality of cartridge parts into an aerosol generating device according to an embodiment, FIG. 4B illustrates a state of the aerosol generating device with the plurality of cartridge parts inserted thereinto, viewed in a direction A of FIG. 4A, according to an embodiment, and FIG. 4C is a view in a direction B of FIG. 4A.

FIG. 5 illustrates an aerosol generating system according to an embodiment.

FIG. 6 illustrates a cartridge and an actuator of an aerosol generating device according to an embodiment.

FIG. 7 illustrates an aerosol generating article according to an embodiment.

MODE FOR THE INVENTION

The terms used in the embodiments are selected from among common terms that are currently widely used, in consideration of their function in the embodiments. However, the terms may become different according to an intention of one of ordinary skill in the art, a precedent, or the advent of new technology. Also, in particular cases, the terms are discretionally selected by the applicant of the disclosure, and the meaning of those terms will be described in detail in the corresponding part of the detailed description. Therefore, the terms used in the disclosure are not merely designations of the terms, but the terms are defined based on the meaning of the terms and content throughout the disclosure.

It will be understood that when a certain part "includes" a certain component, the part does not exclude another component but may further include another component, unless the context clearly dictates otherwise. Also, terms such as "unit," "module," etc., as used in the specification may refer to a part for processing at least one function or operation and may be implemented as hardware, software, or a combination of hardware and software.

As used herein, an expression such as "at least one of" that precedes listed components modifies not each of the listed components but all the components. For example, the expression "at least one of a, b, or c" should be construed as including a, b, c, a and b, a and c, b and c, or a, b, and c.

In an embodiment, an aerosol generating device may be a device that generates an aerosol by electrically heating a cigarette accommodated in an inner space.

The aerosol generating device may include a heater. In an embodiment, the heater may be an electrically resistive heater. For example, the heater may include an electrically conductive track, and the heater may be heated as a current flows through the electrically conductive track.

The heater may include a tubular heating element, a plate-shaped heating element, a needle-shaped heating element, or a rod-shaped heating element, and may heat the inside or outside of the cigarette according to the shape of a heating element.

The cigarette may include a tobacco rod and a filter rod. The tobacco rod may be formed as a sheet or a strand, or may be formed of tobacco leaves finely cut from a tobacco sheet. Also, the tobacco rod may be surrounded by a thermally conductive material. For example, the thermally conductive material may be a metal foil such as aluminum foil. However, embodiments are not limited thereto.

The filter rod may be a cellulose acetate filter. The filter rod may include at least one segment. For example, the filter rod may include a first segment that cools an aerosol and a second segment that filters a predetermined ingredient contained in the aerosol.

In another embodiment, the aerosol generating device may be a device that generates an aerosol using a cartridge containing an aerosol generating material.

The aerosol generating device may include a cartridge containing the aerosol generating material and a main body supporting the cartridge. The cartridge may be detachably coupled to the main body. However, embodiments are not limited thereto. The cartridge may be integrally formed or assembled with the main body, and may be secured to the main body so as not to be detached by a user. The cartridge may be mounted on the main body while the aerosol generating material is accommodated therein. However, embodiments are not limited thereto. The aerosol generating material may be injected into the cartridge while the cartridge is coupled to the main body.

The cartridge may hold the aerosol generating material having any one of various states, such as a liquid state, a solid state, a gaseous state, and a gel state. The aerosol generating material may include a liquid composition. For example, the liquid composition may be a liquid including a tobacco-containing material having a volatile tobacco flavor ingredient, or a liquid including a non-tobacco material.

The cartridge may be operated by an electrical signal or a wireless signal transmitted from the main body to perform the function of generating an aerosol by converting the phase of the aerosol generating material inside the cartridge to a gaseous phase. The aerosol may refer to a gas in which vaporized particles generated from the aerosol generating material are mixed with air.

In another embodiment, the aerosol generating device may generate an aerosol by heating the liquid composition, and the generated aerosol may pass through the cigarette and be delivered to the user. That is, the aerosol generated from the liquid composition may travel along airflow paths of the aerosol generating device, and the airflow paths may be configured to allow the aerosol to pass through the cigarette and be delivered to the user.

In another embodiment, the aerosol generating device may be a device that generates an aerosol from the aerosol generating material using an ultrasonic vibration manner. In this case, the ultrasonic vibration manner may refer to a method of generating an aerosol by atomizing the aerosol generating material with ultrasonic vibration generated by a vibrator.

The aerosol generating device may include a vibrator, and may generate vibration at short intervals through the vibrator to atomize the aerosol generating material. The vibration generated by the vibrator may be ultrasonic vibration, and the frequency band of the ultrasonic vibration may be from about 100 kHz to about 3.5 MHz. However, embodiments are not limited thereto.

The aerosol generating device may further include a wick that absorbs the aerosol generating material. For example, the wick may be disposed to surround at least one area of the vibrator or may be disposed to contact at least one area of the vibrator.

As a voltage (e.g., an alternating voltage) is applied to the vibrator, the vibrator may generate heat and/or ultrasonic vibration, and the heat and/or ultrasonic vibration generated by the vibrator may be transmitted to the aerosol generating material absorbed in the wick. The aerosol generating material absorbed in the wick may be converted into a gas phase by the heat and/or ultrasonic vibration transmitted from the vibrator, and consequently, an aerosol may be generated.

For example, the viscosity of the aerosol generating material absorbed in the wick may be lowered by the heat generated by the vibrator, and the aerosol generating material whose viscosity is lowered may change to fine particles by the ultrasonic vibration generated by the vibrator, so that an aerosol may be generated. However, embodiments are not limited thereto.

In another embodiment, the aerosol generating device may be a device that generates an aerosol by heating the aerosol generating article accommodated therein in an induction heating manner.

The aerosol generating device may include a susceptor and a coil. In an embodiment, the coil may apply a magnetic field to the susceptor. As the aerosol generating device supplies power to the coil, a magnetic field may be formed inside the coil. In an embodiment, the susceptor may be a magnetic body that generates heat by an external magnetic field. As the susceptor is positioned inside the coil and generates heat with the magnetic field applied, the aerosol generating article may be heated. Also, optionally, the susceptor may be positioned in the aerosol generating article.

In another embodiment, the aerosol generating device may further include a cradle.

The aerosol generating device and the separate cradle may form a system together. For example, the cradle may be used to charge a battery of the aerosol generating device. Alternatively, a heater may be heated when the cradle and the aerosol generating device are coupled to each other.

Hereinafter, embodiments of the disclosure will be described in detail with reference to the accompanying drawings such that one of ordinary skill in the art may easily practice the disclosure. The disclosure may be practiced in forms that are implementable in the aerosol generating devices according to various example embodiments described above or may be embodied and practiced in many different forms and is not limited to the embodiments described herein.

Hereinafter, embodiments of the disclosure will be described in detail with reference to the drawings.

Referring to FIG. 1, an aerosol generating device 100 may include a controller 110, a sensing unit 120, an output unit 130, a battery 140, a heater 150, a user input unit 160, a memory 170, and a communication unit 180. However, the internal structure of the aerosol generating device 100 is not limited to what is shown in FIG. 1. It is to be understood by one of ordinary skill in the art to which the disclosure pertains that some of the components shown in FIG. 1 may be omitted or new components may be added according to the design of the aerosol generating device 100.

The sensing unit 120 may sense a state of the aerosol generating device 100 or a state of an environment around the aerosol generating device 100, and transmit sensing information obtained through the sensing to the controller 110. Based on the sensing information, the controller 110 may control the aerosol generating device 100 to control operations of the heater 150, restrict smoking, determine whether an aerosol generating article (e.g., a cigarette, a cartridge, etc.) is inserted, display a notification, and perform other functions.

The sensing unit 120 may include at least one of a temperature sensor 122, an insertion detection sensor 124, or a puff sensor 126. However, embodiments are not limited thereto.

The temperature sensor 122 may sense a temperature at which the heater 150 (or an aerosol generating material) is heated. The aerosol generating device 100 may include a separate temperature sensor for sensing the temperature of the heater 150, or the heater 150 itself may perform a function as a temperature sensor. Alternatively, the temperature sensor 122 may be arranged around the battery 140 to monitor the temperature of the battery 140.

The insertion detection sensor 124 may sense whether the aerosol generating article is inserted or removed. The insertion detection sensor 124 may include, for example, at least one of a film sensor, a pressure sensor, a light sensor, a resistive sensor, a capacitive sensor, an inductive sensor, or an infrared sensor, which may sense a signal change by the insertion or removal of the aerosol generating article.

The puff sensor 126 may sense a puff from a user based on various physical changes in an airflow path or airflow channel. For example, the puff sensor 126 may sense the puff of the user based on any one of a temperature change, a flow change, a voltage change, and a pressure change.

The sensing unit 120 may further include at least one of a temperature/humidity sensor, an atmospheric pressure sensor, a magnetic sensor, an acceleration sensor, a gyroscope sensor, a position sensor (e.g., a global positioning system (GPS)), a proximity sensor, or a red, green, blue (RGB) sensor (e.g., an illuminance sensor), in addition to the sensors 122 through 126 described above. A function of each sensor may be intuitively inferable from its name by one of ordinary skill in the art, and thus, a more detailed description thereof will be omitted here.

The output unit 130 may output information about the state of the aerosol generating device 100 and provide the information to the user. The output unit 130 may include at least one of a display 132, a haptic portion 134, or a sound outputter 136. However, embodiments are not limited thereto. When the display 132 and a touchpad are provided in a layered structure to form a touchscreen, the display 132 may be used as an input device in addition to an output device.

The display 132 may visually provide information about the aerosol generating device 100 to the user. The information about the aerosol generating device 100 may include, for example, a charging/discharging state of the battery 140 of the aerosol generating device 100, a preheating state of the heater 150, an insertion/removal state of the aerosol generating article, a limited usage state (e.g., an abnormal article detected) of the aerosol generating device 100, or the like, and the display 132 may externally output the information. The display 132 may be, for example, a liquid-crystal display panel (LCD), an organic light-emitting display panel (OLED), or the like. The display 132 may also be in the form of a light-emitting diode (LED) device.

The haptic portion 134 may provide information about the aerosol generating device 100 to the user in a haptic way by converting an electrical signal into a mechanical stimulus or an electrical stimulus. The haptic portion 134 may include, for example, a motor, a piezoelectric element, or an electrical stimulation device.

The sound outputter 136 may provide information about the aerosol generating device 100 to the user in an auditory way. For example, the sound outputter 136 may convert an electrical signal into a sound signal and externally output the sound signal.

The battery 140 may supply power to be used to operate the aerosol generating device 100. The battery 140 may supply power to heat the heater 150. In addition, the battery 140 may supply power required for operations of the other components (e.g., the sensing unit 120, the output unit 130, the user input unit 160, the memory 170, and the communication unit 180) included in the aerosol generating device 100. The battery 140 may be a rechargeable battery or a disposable battery. The battery 140 may be, for example, a lithium polymer (LiPoly) battery. However, embodiments are not limited thereto.

The heater 150 may receive power from the battery 140 to heat the aerosol generating material. Although not shown in FIG. 1, the aerosol generating device 100 may further include a power conversion circuit (e.g., a direct current (DC)-to-DC (DC/DC) converter) that converts power of the battery 140 and supplies the power to the heater 150. In addition, when the aerosol generating device 100 generates an aerosol in an induction heating manner, the aerosol generating device 100 may further include a DC-to-alternating current (AC) (DC/AC) converter that converts DC power of the battery 140 into AC power.

The controller 110, the sensing unit 120, the output unit 130, the user input unit 160, the memory 170, and the communication unit 180 may receive power from the battery 140 to perform functions. Although not shown in FIG. 1, the aerosol generating device 100 may further include a power conversion circuit, for example, a low dropout (LDO) circuit or a voltage regulator circuit, which converts power of the battery 140 and supplies the power to respective components.

According to an embodiment, the heater 150 may be formed of a predetermined electrically resistive material that is suitable. The electrically resistive material may be a metal or a metal alloy including, for example, titanium, zirconium, tantalum, platinum, nickel, cobalt, chromium, hafnium, niobium, molybdenum, tungsten, tin, gallium, manganese, iron, copper, stainless steel, nichrome, or the like. However, embodiments are not limited thereto. In addition, the heater 150 may be implemented as a metal heating wire, a metal heating plate on which an electrically conductive track is arranged, a ceramic heating element, or the like. However, embodiments are not limited thereto.

In another embodiment, the heater 150 may be an induction heater. For example, the heater 150 may include a susceptor that heats the aerosol generating material by generating heat through a magnetic field applied by a coil.

The user input unit 160 may receive information input from the user or may output information to the user. For example, the user input unit 160 may include a keypad, a dome switch, a touchpad (e.g., a contact capacitive type, a pressure resistive film type, an infrared sensing type, a surface ultrasonic conduction type, an integral tension measurement type, a piezo effect method, etc.), a jog wheel, a jog switch, or the like. However, embodiments are not limited thereto. In addition, although not shown in FIG. 1, the aerosol generating device 100 may further include a connection interface such as a universal serial bus (USB) interface, and may be connected to another external device through the connection interface such as a USB interface to transmit and receive information or to charge the battery 140.

The memory 170, which is hardware for storing various pieces of data processed in the aerosol generating device 100, may store data processed by the controller 110 and data to be processed thereby. The memory 170 may include at least one type of storage medium of a flash memory type memory, a hard disk type memory, a multimedia card micro type memory, a card type memory (e.g., an SD or XE memory), a random access memory (RAM), a static random access memory (SRAM), a read-only memory (ROM), an electrically erasable programmable read-only memory (EEPROM), a programmable read-only memory (PROM), a magnetic memory, a magnetic disk, or an optical disk. The memory 170 may store an operating time of the aerosol generating device 100, a maximum number of puffs, a current number of puffs, at least one temperature profile, data associated with a smoking pattern of the user, or the like.

The communication unit 180 may include at least one component for communicating with another electronic device. For example, the communication unit 180 may include a short-range communication unit 182 and a wireless communication unit 184.

The short-range wireless communication unit 182 may include a Bluetooth communication unit, a BLE communication unit, a near field communication unit, a WLAN (Wi-Fi) communication unit, a ZigBee communication unit, an infrared data association (IrDA) communication unit, a Wi-Fi direct (WFD) communication unit, an ultra-wideband (UWB) communication unit, and an Ant+ communication unit. However, embodiments are not limited thereto.

The wireless communication unit 184 may include, for example, a cellular network communicator, an Internet communicator, a computer network (e.g., a local area network (LAN) or a wide-area network (WAN)) communicator, or the like. However, embodiments are not limited thereto. The wireless communication unit 184 may use subscriber information (e.g., international mobile subscriber identity (IMSI)) to identify and authenticate the aerosol generating device 100 in a communication network.

The controller 110 may control the overall operation of the aerosol generating device 100. In an embodiment, the controller 110 may include at least one processor. The processor may be implemented as an array of a plurality of logic gates, or may be implemented as a combination of a general-purpose microprocessor and a memory in which a program executable by the microprocessor is stored. In addition, it is to be understood by one of ordinary skill in the art to which the disclosure pertains that it may be implemented in other types of hardware.

The controller 110 may control the temperature of the heater 150 by controlling the supply of power from the battery 140 to the heater 150. For example, the controller 110 may control the supply of power by controlling the switching of a switching element between the battery 140 and the heater 150. In another example, a direct heating circuit may control the supply of power to the heater 150 according to a control command from the controller 110.

The controller 110 may analyze a sensing result obtained by the sensing of the sensing unit 120 and control processes to be performed thereafter. For example, the controller 110 may control power to be supplied to the heater 150 to start or end an operation of the heater 150 based on the sensing result obtained by the sensing unit 120. As another example, the controller 110 may control an amount of power to be supplied to the heater 150 and a time for which the power is to be supplied, such that the heater 150 may be heated up to a predetermined temperature or maintained at a desired temperature, based on the sensing result obtained by the sensing unit 120.

The controller 110 may control the output unit 130 based on the sensing result obtained by the sensing unit 120. For example, when the number of puffs counted through the puff sensor 126 reaches a preset number, the controller 110 may inform the user that the aerosol generating device 100 is to be ended soon, through at least one of the display 132, the haptic portion 134, or the sound outputter 136.

According to an embodiment, the controller 110 may control a power supply time and/or a power supply amount for the heater 150 according to a state of the aerosol generating article sensed by the sensing unit 120. For example, when the aerosol generating article (e.g., an aerosol generating article 201) is in an over-humidified state, the controller 110 may control the power supply time for an inductive coil to increase a preheating time, compared to a case where the aerosol generating article (e.g., the aerosol generating article 201) is in a general state.

Referring to FIGS. 2 to 7, an aerosol generating system 20 may include an aerosol generating device 200 and an aerosol generating article 201. The aerosol generating device 200 may accommodate the aerosol generating article 201 in an inner space (e.g., an article insertion portion 2121 of FIG. 2) and electrically heat the aerosol generating article 201 to generate an aerosol.

Referring to FIG. 2, the aerosol generating device 200 may include a housing 210, a cartridge 220, and an actuator 230.

In an embodiment, the housing 210 may include a first housing part 211 and a second housing part 212 to be coupled to the first housing part 211. For example, the first housing part 211 and the second housing part 212 may be rotatably connected about a hinge 213. The housing 210 may change in state from an open mode to a closed mode. In the open mode, the first housing part 211 and the second housing part 212 may be separated around the hinge 213. In the closed mode, the first housing part 211 and the second housing part 212 may be coupled to be in close contact with each other. In the open mode, one surface of the second housing part 212 facing the first housing part 211 may be exposed. Also, a cartridge receiver 2111 may also be exposed to an outside of the second housing part 212, such that the cartridge 220 may be inserted into the cartridge receiver 2111.

In an embodiment, the cartridge receiver 2111 may be provided on one side of the first housing part 211 so that the cartridge 220 may be inserted thereinto. The cartridge receiver 2111 may be implemented as a space depressed inwardly from one surface of the first housing part 211.

In an embodiment, the actuator 230 may be disposed adjacent to the cartridge receiver 2111 inside the first housing part 211. The actuator 230 may activate the cartridge 220 received in the cartridge receiver 2111, which will be described in detail later. A power supply unit (e.g., a battery) (not shown) and a controller (not shown) may be disposed adjacent to the actuator 230 to contribute to the activation by the actuator 230.

Referring to FIG. 3, according to an embodiment, the cartridge 220 may be inserted into the cartridge receiver 2111 of the aerosol generating device 200, and the outer shape of the cartridge 220 may be implemented as a shape corresponding to the shape of the cartridge receiver 2111. For example, a liquid fragrance may be accommodated in the cartridge 200, and the liquid fragrance may be discharged from the cartridge 200 through liquid injection pins 2211, 2221, and 2231 protruding from the cartridge 200.

The protruding length of the liquid injection pins 2211, 2221, and 2231 may be set to a length that allows at least a portion of the liquid injection pins 2211, 2221, and 2231 to protrude to the outside of the first housing part 211 while the cartridge 220 is inserted into the cartridge receiver 2111.

Referring to FIGS. 4A to 4C, according to an embodiment, the cartridge 220 of the aerosol generating device 200 may include a plurality of cartridge parts 221, 222, and 223, which accommodate different liquid fragrances. For example, the cartridge 220 may include a first cartridge part 221, a second cartridge part 222, and a third cartridge part 223. The number of cartridge parts 221, 222, and 223 is not necessarily limited thereto. For example, the cartridge 220 may include the first cartridge part 221 and the second cartridge part 222 only.

In an embodiment, the first cartridge part 221 may accommodate a first liquid fragrance, the second cartridge part 222 may accommodate a second liquid fragrance, and the third cartridge part 223 may accommodate a third liquid fragrance. For example, the first liquid fragrance, the second liquid fragrance, or the third liquid fragrance may be a different concentrate, and may include menthol, peppermint, spearmint oil, various fruit flavor components, and the like, or may include ingredients that provide a user with a variety of flavors or scents. In addition, the first cartridge part 221, the second cartridge part 222, or the third cartridge part 223 may accommodate a vitamin mixture, for example, may accommodate vitamin A, vitamin B, vitamin C, vitamin E, or a mixture in which at least one thereof is mixed. However, embodiments are not limited thereto.

In an embodiment, the cartridge receiver 2111 may include a plurality of compartments which are divided so that each compartment receives a corresponding cartridge part (e.g., the first cartridge part 221, the second cartridge part 222, or the third cartridge part 223). For example, as shown in FIG. 4B, the cartridge receiver 2111 may include three compartments that are divided by partition walls. Since the cartridge receiver 2111 includes the divided compartments, when a liquid fragrance accommodated in one of the cartridge parts 221, 222, and 223 is exhausted, the cartridge part may be easily replaced. The cartridge receiver 2111 may have a circular cross section when viewed from the second housing part 212, and the plurality of compartments of the cartridge receiver 2111 may be divided at equal intervals. In this case, the first cartridge part 221, the second cartridge part 222, and the third cartridge part 223 may also have a cylindrical shape divided and cut at equal intervals.

In an embodiment, the first liquid injection pin 2211 may be provided at one end of the first cartridge part 221, the second liquid injection pin 2221 may be provided at one end of the second cartridge part 222, and the third liquid injection pin 2231 may be provided at one end of the third cartridge part 223. The first liquid injection pin 2211, the second liquid injection pin 2221, and the third liquid injection pin 2231 may be disposed close to the center point where the cartridge parts 221, 222, and 223 meet, and the cartridge receiver 2111 may be formed to have the diameter D greater than the diameter d of the article insertion portion 2121. Thereby, a front end (an upstream side) of the aerosol generating article 201 may be guided to meet the first liquid injection pin 2211, the second liquid injection pin 2221, and the third liquid injection pin 2231.

In an embodiment, the actuator 230 may activate the first cartridge part 221, the second cartridge part 222 and the third cartridge part 223 individually. For example, the actuator 230 may allow the first liquid fragrance accommodated in the first cartridge part 221 to be discharged in a preset amount through the first liquid injection pin 2211 and the second liquid fragrance accommodated in the second cartridge part 222 to be discharged in a preset amount through the second liquid injection pin 2221, thereby allowing a preset combination of the first liquid fragrance and the second liquid fragrance to be supplied toward the article insertion portion 2121. This may allow the combination of the first liquid fragrance and the second liquid fragrance to be supplied to the aerosol generating article 201. This is merely an example, and embodiments are not necessarily limited thereto. For example, the actuator 230 may activate the first cartridge part 221 to supply only the first liquid fragrance to the aerosol generating article 201, or may activate the first cartridge part 221, the second cartridge part 222, and the third cartridge part 223 individually to supply a combination of the first to third liquid fragrances to the aerosol generating article 201.

In an embodiment, on one surface of one of the first housing part 211 and the second housing part 212 may be provided a protrusion 2122 protruding toward the other one of the first housing part 211 and the second housing part 212. For example, referring to FIG. 4B, the protrusion 2122 may be formed on one surface of the first housing part 211 facing the second housing part 212. As another example, the protrusion 2122 may be formed on one surface of the second housing part 212 facing the first housing part 211. A plurality of protrusions 2122 may be provided, and each of the protrusions 2122 may include a hard material to hinder a surface contact between the first housing part 211 and the second housing part 212. A separation space between the first housing part 211 and the second housing part 212 may be formed by the protrusion 2122, and the separation space may be in fluid communication with the article insertion portion 2121, such that an airflow path from the outside of the aerosol generating device 200 to the article insertion portion 2121 may be formed.

In particular, referring to FIG. 4C, according to an embodiment, the aerosol generating device 200 may further include a cartridge holder 2124. The cartridge holder 2124 may be provided on one surface of the second housing part 212 facing the first housing part 211, and specifically at an end portion of the article insertion portion 2121 facing the first housing part 211. The cartridge holder 2124 may be in contact with at least a portion of the cartridge 220 to hold the cartridge 220 in place within the cartridge receiver 2111.

For example, the cartridge holder 2124 may be formed to overlap an outer side of an upper portion (e.g., a surface on which the first liquid injection pin 2211 is disposed) of the first cartridge part 221 and not overlap an inner side of the upper portion where the first liquid injection pin 2211 is disposed. Similarly, the cartridge holder 2124 may be formed to overlap an outer side of an upper portion (e.g., a surface on which the second liquid injection pin 2221 is disposed) of the second cartridge part 222 and not overlap an inner side of the upper portion where the second liquid injection pin 2221 is disposed. Also, the cartridge holder 2124 may be formed to overlap an outer side of an upper portion (e.g., a surface on which the third liquid injection pin 2231 is disposed) of the third cartridge part 223 and not overlap an inner side of the upper portion where the third liquid injection pin 2231 is disposed. In this case, the diameter (W) formed by the non-overlapping portions of the cartridge holder 2124 may be less than the diameter (D) of the cartridge receiver 2111. Further, the cartridge holder 2124 may include a plurality of bars covering boundary areas of the cartridge parts 221, 222, and 223. Accordingly, when the first housing part 211 and the second housing part 212 are coupled, the cartridge holder 2124 may hold the cartridge parts 221, 222, and 223 in place while pressing the cartridge parts 221, 222, and 223 into the cartridge receiver 2111, and the first liquid injection pin 2211, the second liquid injection pin 2221, and the third liquid injection pin 2231 may protrude to extend beyond the cartridge holder 2124 to the article insertion portion 2121.

Referring to FIGS. 5 to 7, according to an embodiment, the aerosol generating system 20 may include the aerosol generating device 200 and the aerosol generating article 201. Specifically, FIG. 5 illustrates a state of the aerosol generating article 201 being inserted into the aerosol generating device 200 according to an embodiment. FIG. 6 illustrates a portion of the cartridge 220 and a portion of the actuator 230 according to an embodiment. FIG. 7 illustrates the aerosol generating article 201 according to an embodiment.

In particular, referring to FIG. 5, according to an embodiment, in the closed mode of the aerosol generating device 200, the actuator 230, the cartridge 220, and the article insertion portion 2121 may be aligned in a line. Thereby, the aerosol generating article 201 inserted into the article insertion portion 2121 may also be aligned with the cartridge 220 and the actuator 230 in a line, causing the first liquid injection pin 2211, the second liquid injection pin 2221, and the third liquid injection pin 2231 to be stuck in the front end of the aerosol generating article 201, such that one or more of the first to third liquid fragrances may be supplied to the aerosol generating article 201.

In an embodiment, the article insertion portion 2121 may be formed to penetrate through the second housing part 212. In the closed mode, the center line of the article insertion portion 2121 may pass through the cartridge receiver 2111 and the actuator 230.

In an embodiment, the diameter of the cartridge receiver 2111 (e.g., diameter D of the cartridge receiver of FIG. 4B) may be greater than a diameter of the article insertion portion 2121 (e.g., the diameter d of the article inserting portion of FIG. 4B). This may effectively prevent the cartridge 220 from being separated from the article insertion portion 2121 in the closed mode in which the cartridge 220 is placed in the cartridge receiver 2111 and the first housing part 211 and the second housing part 212 are coupled.

In an embodiment, as shown in FIG. 6, the first liquid injection pin 2211 may be provided at one end of the first cartridge part 221, and the first cartridge head 2212 may be provided in the first cartridge part 221. The first cartridge head 2212 may move in the first cartridge part 221 to discharge the first liquid fragrance accommodated in the first cartridge part 221 out of the first liquid injection pin 2211. For example, the inside of the first cartridge part 221 may have a horizontal cross section of a constant shape (e.g., triangle as shown in FIG. 6) along the longitudinal direction, and the first cartridge head 2212 may have a shape corresponding to the horizontal cross section of the first cartridge part 221 to seal the inside of the first cartridge part 221. Here, the longitudinal direction is perpendicular to the cutting plane for the horizontal cross section. Likewise, the second cartridge part 222 and the third cartridge part 223 of the cartridge 230 may also include the same or similar elements as the first cartridge part 221.

In an embodiment, the actuator 230 may include a first push bar 231 configured to strike or push the first cartridge head 2212 in the first cartridge part 221, and a driving element (not shown) configured to transmit a forward and backward driving force to the first push bar 231. For example, the first push bar 231 and the driving element may be connected by a crankshaft or connected by a rack and pinion gear, so that a rotational motion of the driving element may be changed into a linear motion and transmitted to the first push bar 231.

Similarly, the actuator 230 may include a second push bar (not shown) configured to strike or push a second cartridge head (not shown) of the second cartridge part 222 or a third push bar 233 (see FIG. 5) configured to strike or push a third cartridge head (not shown) of the third cartridge part 223.

For example, the first push bar 231 may push the first cartridge head 2212 toward the first liquid injection pin 2211, and the first liquid fragrance may be supplied to the front end of the aerosol generating article 201 through the first liquid injection pin 2211. To this end, a controller (not shown) may instruct the first push bar 231 to drive forward a preset length, ensuring precise discharge of the first liquid fragrance. After moving forward, the first cartridge head 2212 may stay in that position to prevent external air from entering the first cartridge part 221. In the manner described above, the second liquid fragrance or the third liquid fragrance may be precisely supplied to the aerosol generating article 201.

In particular, referring to FIG. 7, the aerosol generating article 201 may sequentially include a moisturizer accommodating portion 2011, a medium accommodating portion 2012, and a filter portion 2013.

In an embodiment, the aerosol generating article 201 may be wrapped by at least one wrapper. In addition, the moisturizer accommodating portion 2011 may include a material having waterproof, water-repellent, oil-repellent, or heat-resistant properties, and may include, for example, aluminum foil. The medium accommodating portion 2012 may include a tobacco medium, for example, cut tobacco leaves or tobacco granules. Further, the medium accommodating portion 2012 may contain other additives such as a flavoring agent or an organic acid. The moisturizer accommodating portion 2011 may contain a moisturizer, and the moisturizer may include, for example, glycerin, propylene glycol (PG), and water. In addition, the moisturizer may further include at least one of glycerin, propylene glycol, ethylene glycol, dipropylene glycol, diethylene glycol, triethylene glycol, tetraethylene glycol, or oleyl alcohol. The filter portion 2013 may include at least one segment, and may include a tobacco filter wrapper surrounding the at least one segment. The filter portion 2013 may include at least one of a tubular filter, a cooling structure, or a recessed filter. However, embodiments are not limited thereto.

Since glycerin included in the moisturizer has a high molecular weight, the moisturizer needs to be heated at a high temperature to aerosolize the glycerin. When the aerosol generating article 201 includes the moisturizer accommodating portion 2011 containing the moisturizer, it is possible to reduce the amount of moisturizer contained in the medium accommodating portion 2012 or remove the moisturizer from the medium accommodating portion 2012, thereby lowering the heating temperature of the medium accommodating portion 2012. Meanwhile, the moisturizer contained in the moisturizer accommodating portion 2011 may maintain an appropriate level of moisture in an aerosol generated when heated, thereby mellowing a unique taste of tobacco and enriching an amount of atomization.

In an embodiment, a heater 2123 may be provided in at least a portion of the perimeter of the article insertion portion 2121. The heater 2123 may include a first heater 2123-1 disposed around the moisturizer accommodating portion 2011 or a second heater 2123-2 disposed around the medium accommodating portion 2012. At this time, the second heater 2123-2 for heating the medium accommodating portion 2012 may be omitted.

For example, the aerosol generating device 200 may heat the moisturizer accommodating portion 2011 and the medium accommodating portion 2012 individually using the first heater 2123-1 and the second heater 2123-2. The first heater 2123-1 may heat the moisturizer accommodating portion 2011 in a first temperature range. The first temperature range may be from 200° C. to 300° C., preferably, from 200° C. to 250° C. The second heater 2123-2 may heat the tobacco medium in a second temperature range to aerosolize nicotine contained in the medium accommodating portion 2012. The second temperature range may be from 150° C. to 200° C. However, the first temperature range and the second temperature range are not limited thereto.

Since the moisturizer accommodating portion 2011 is positioned at an upstream end of the medium accommodating portion 2012, when a user sucks a cigarette, air introduced from an upstream end of the cigarette may be heated by the first heater 2123-1 while passing through the moisturizer accommodating portion 2011, and the moisturizer (e.g., glycerin) may be aerosolized. In addition, the air having passed through the moisturizer accommodating portion 2011 may be heated by the second heater 2123-2 while passing through the medium accommodating portion 2012, and the medium (e.g., nicotine) may be additionally aerosolized. At this time, since the air introduced into the medium accommodating portion 2012 is high-temperature air heated by the first heater 2123-1, the medium accommodating portion 2012 may absorb heat from the high-temperature air as well as the second heater 2123-2 to aerosolize the medium.

For example, the controller (not shown) may be configured to identify whether the aerosol generating article 201 is inserted into the article insertion portion 2121 as well as the type of the aerosol generating article 201. The controller may transmit an activation signal to the actuator 230 according to a liquid fragrance combination ratio preset by the type of the aerosol generating product 201. Thereby, a preset combination of liquid fragrances may be supplied from the cartridge 220 to the moisturizer accommodating portion 2011 of the aerosol generating article 201. The controller may heat the periphery of the moisturizer accommodating portion 2011 at a heating temperature of the first heater 2123-1 set by the type of aerosol generating article. Thereby, an aerosol with an optimal taste combination and an amount of atomization according to the type of the aerosol generating article 201 may be delivered to the mouth of the user through the filter portion 2013.

The descriptions of the above-described embodiments are merely examples, and it will be understood by one of ordinary skill in the art that various changes and equivalents may be made thereto. Therefore, the scope of the disclosure should be defined by the appended claims, and all differences within the scope equivalent to those described in the claims will be construed as being included in the scope of protection defined by the claims.

The features and aspects of any embodiment(s) described above may be combined with features and aspects of any other embodiment(s) without resulting in apparent technical conflicts.

The invention claimed is:

1. An aerosol generating device, comprising:
a housing;
a cartridge insertable into the housing and configured to store at least one liquid, the cartridge comprising a cartridge part and a liquid injection pin that protrudes from one end of the cartridge part and is configured to communicate with an inside of the cartridge part;
an actuator provided in the housing and configured to push the liquid in the cartridge; and
an article insertion portion provided on the cartridge and configured to receive an aerosol generating article.

2. The aerosol generating device of claim 1, wherein the cartridge part comprises:
a first cartridge part configured to accommodate a first liquid fragrance; and
a second cartridge part configured to accommodate a second liquid fragrance, and
the actuator comprises:
a first push bar configured to push one end of the first cartridge part; and
a second push bar configured to push one end of the second cartridge part.

3. The aerosol generating device of claim 1, wherein the cartridge part is configured to accommodate a liquid fragrance, and
the cartridge comprises:
a cartridge head provided in the cartridge part and configured to move in the cartridge part.

4. The aerosol generating device of claim 3, wherein
a cross section of the cartridge part is constant when taken along a horizontal cutting plane perpendicular to a longitudinal direction, and
the cartridge head has a shape corresponding to the cross section of the cartridge part such that the inside of the cartridge part is sealed by the cartridge head.

5. The aerosol generating device of claim 4, wherein
the actuator comprises:
a push bar connected to the cartridge head; and
a driving element configured to push and pull the push bar in the longitudinal direction.

6. The aerosol generating device of claim 1, wherein
the housing comprises:
a first housing part configured to receive the cartridge and the actuator; and
a second housing part connected to the first housing part and comprising the article insertion portion,
wherein the first housing part comprises a cartridge receiver for receiving the cartridge, and
the article insertion portion is formed to penetrate through the second housing part and is aligned with the cartridge receiver.

7. The aerosol generating device of claim 6, wherein
the first housing part and the second housing part are connected by a hinge.

8. The aerosol generating device of claim 6, wherein
a diameter of the cartridge receiver is greater than a diameter of the article insertion portion.

9. The aerosol generating device of claim 6, wherein
one of the first housing part and the second housing part comprises a protrusion protruding toward the other of the first housing part and the second housing part,
the protrusion forms a separation space between the first housing part and the second housing part, and
the separation space and the article insertion portion communicate with each other to form an airflow path.

10. The aerosol generating device of claim 6, further comprising:
a cartridge holder provided on one side of the second housing part facing the first housing part,
wherein the cartridge holder is configured to hold the cartridge in place within the cartridge receiver.

11. The aerosol generating device of claim 1, wherein
a heater is provided on at least a portion of a perimeter of the article insertion portion.

12. An aerosol generating device, comprising:
a housing;
a cartridge insertable into the housing and comprising:
a plurality of cartridge parts configured to accommodate different liquids, and
a liquid injection pin protruding from one end of a corresponding cartridge part and configured to communicate with an inside of the corresponding cartridge part;
an actuator provided in the housing and configured to activate the cartridge parts; and
an article insertion portion provided on the cartridge and configured to receive an aerosol generating article,
wherein the actuator activates the cartridge parts individually such that at least one of the liquids is delivered to the article insertion portion.

13. The aerosol generating device of claim 12, wherein
the cartridge comprises:
a first cartridge part configured to accommodate a first liquid fragrance; and
a second cartridge part configured to accommodate a second liquid fragrance,
wherein the actuator comprises a plurality of push bars configured to push the first cartridge part and the second cartridge part, respectively, and
the first liquid fragrance and the second liquid fragrance are delivered to the article insertion portion.

14. The aerosol generating device of claim 13, wherein
the housing comprises a first housing part, and a second housing part connected to the first housing part by a hinge,
a cartridge receiver for receiving the cartridge is provided on one side of the first housing part facing the second housing part to receive the cartridge,
the article insertion portion is formed to penetrate through the second housing part, and
the actuator, the cartridge receiver, and the article insertion portion are aligned in a line.

15. An aerosol generating device, comprising:
a housing;
a cartridge insertable into the housing and comprising a liquid injection pin which communicates with an inside where the liquid is accommodated;
an article insertion portion disposed to be in contact with the cartridge and configured to receive an aerosol generating article,
wherein the liquid injection pin protrudes toward the article insertion portion.

16. The aerosol generating device of claim 15, further comprising:
an actuator configured to push the liquid in the cartridge,
wherein the cartridge comprises a cartridge head configured to move in a cartridge part to push the liquid toward the liquid injection pin, and
the actuator comprises a push bar connected to the cartridge head, and a driving element configured to push and pull the push bar.

* * * * *